US005378066A

United States Patent [19]

Wade

[11] Patent Number: 5,378,066

[45] **Date of Patent: * Jan. 3, 1995**

[54] OPENING DEVICE FOR FLEXIBLE PACKAGING

[75] Inventor: Steven E. Wade, Winona, W. Va.

[73] Assignee: Greenbrier Innovations, Inc., Hinton, W. Va.

[ * ] Notice: The portion of the term of this patent subsequent to Jun. 1, 2010 has been disclaimed.

[21] Appl. No.: 69,278

[22] Filed: May 28, 1993

Related U.S. Application Data

[63] Continuation-in-part of Ser. No. 863,016, Apr. 3, 1992, Pat. No. 5,215,381, which is a continuation-in-part of Ser. No. 510,203, Apr. 17, 1990, Pat. No. 5,127,065.

[51] Int. Cl.[6] ..... B65D 3/26

[52] U.S. Cl. ..... 383/205; 383/200

[58] Field of Search ..... 383/200, 205; 229/238, 229/924, 925, 926

[56] References Cited

U.S. PATENT DOCUMENTS

| | | | |
|---|---|---|---|
| 1,587,280 | 6/1926 | Burke . | |
| 1,983,400 | 12/1934 | Reiner . | |
| 2,009,835 | 7/1935 | Burke | 383/205 |
| 2,119,793 | 6/1938 | Plageman . | |
| 2,152,400 | 3/1939 | DaRold . | |
| 2,263,353 | 11/1941 | Eidam . | |
| 2,622,986 | 12/1952 | Snyder et al. | 383/200 |
| 2,819,010 | 1/1958 | Amiguet | 383/200 |
| 3,098,601 | 7/1963 | Anderson et al. | 383/205 |
| 3,170,619 | 2/1965 | Repko . | |
| 3,259,235 | 7/1966 | Scowle . | |
| 3,397,835 | 8/1968 | Henning . | |
| 3,446,632 | 5/1969 | Ve Van . | |
| 3,520,469 | 7/1970 | Marx | 383/205 |
| 3,561,665 | 2/1971 | Smith . | |
| 3,615,711 | 10/1971 | Marcus et al. . | |
| 3,695,417 | 10/1972 | Stoker, Jr. . | |
| 3,711,011 | 1/1973 | Kugler | 383/205 |
| 3,730,337 | 5/1973 | White . | |
| 3,730,421 | 5/1973 | Stanley . | |
| 3,759,439 | 9/1973 | Cross et al. | 383/205 |
| 3,799,389 | 3/1974 | Bloeck . | |
| 4,027,819 | 6/1977 | Herrera-Gutierrez . | |
| 4,363,406 | 12/1982 | Salvadori . | |
| 4,480,751 | 11/1984 | Lueptow . | |
| 4,480,752 | 11/1984 | Jacobs . | |
| 4,522,305 | 6/1985 | Jacobsson | 383/205 |
| 4,597,450 | 7/1986 | Budmiger . | |
| 4,619,650 | 10/1986 | Wisdom . | |
| 4,664,263 | 5/1987 | Emslander et al. . | |

(List continued on next page.)

FOREIGN PATENT DOCUMENTS

| | | | |
|---|---|---|---|
| 1065305 | 1/1954 | France . | |
| 2242746 | 9/1990 | Japan . | |
| 387271 | 2/1933 | United Kingdom | 383/200 |
| 799284 | 8/1958 | United Kingdom | 383/205 |
| WO91/16239 | 10/1991 | WIPO . | |

*Primary Examiner*—David T. Fidei

*Attorney, Agent, or Firm*—Kerkam, Stowell, Kondracki & Clarke

[57] ABSTRACT

An opening device for flexible packaging and a package having an opening device bonded thereto are provided, wherein the opening device concentrates tearing forces and provides increased tearing leverage, facilitating the opening of the packaging without the need for a sharp object to initiate the tear. The opening device may employ first and second wings spaced apart from one another at a narrow distance and joined at a proximal end by an integral web, which acts as a fulcrum for each of the wings as they are rotated to initiate the tear, or may employ first and second wings or levers secured to opposite sides of a sealed edge of the package, which levers operate about a common fulcrum at the innermost portions of the proximal ends of the levers to magnify and concentrate tearing forces. Another embodiment employs a single lever whose fulcrum is established at a point where a bottom edge of the lever contacts, through the thickness of the packaging material, a surface of the product contained in the package, and the load is positioned at an upper extent of a bonded region joining the packaging material to the proximal end of the lever.

17 Claims, 9 Drawing Sheets

U.S. PATENT DOCUMENTS 4,696,404 9/1987 Corella .
4,708,249 11/1987 Emslander et al. .
4,792,060 12/1988 Brogli .
4,798,295 1/1989 Rausing ..... 229/238
4,838,429 6/1989 Fabisiewicz et al. ..... 383/205
4,855,168 8/1989 Imaizumi ..... 383/205
4,925,034 5/1990 Robichaud et al. .
4,958,735 9/1990 Odabashian .
5,018,625 5/1991 Focke et al. ..... 229/924
5,035,328 7/1991 Kim .
5,127,065 6/1992 Wade .
5,215,381 6/1993 Wade .

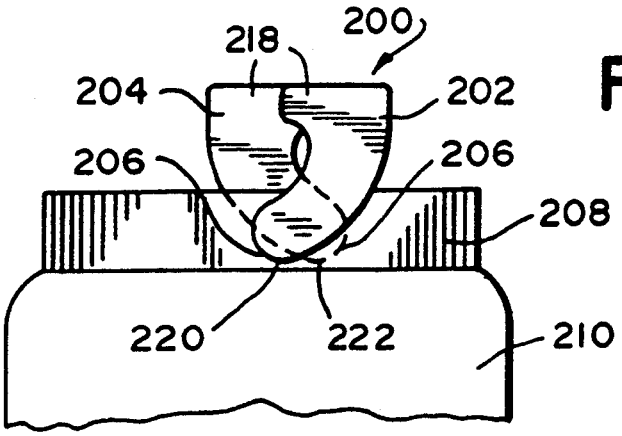
FIG. 9
FIG. 10
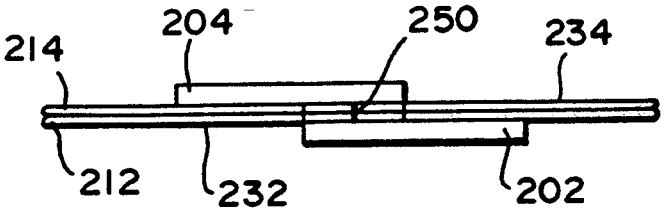
FIG. 11
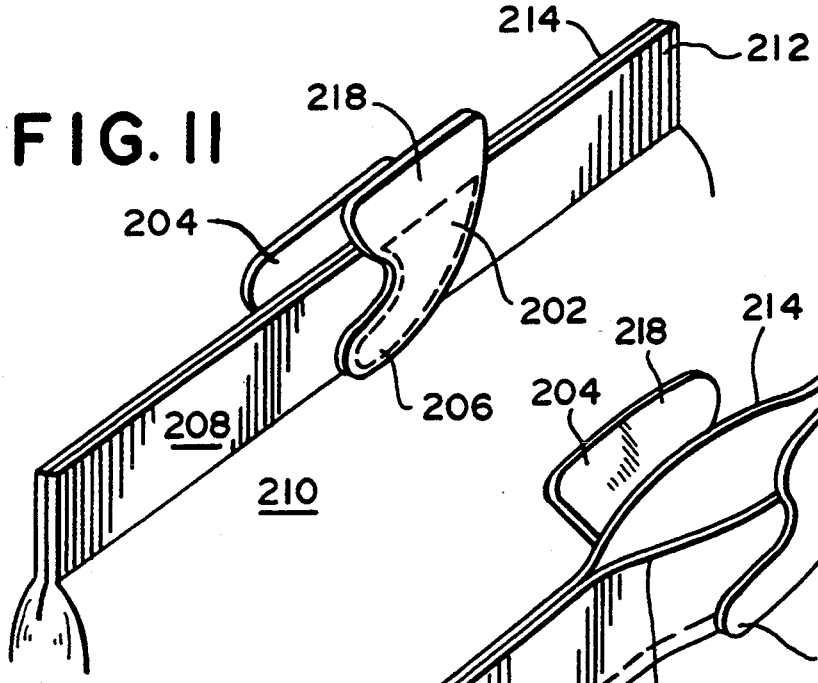
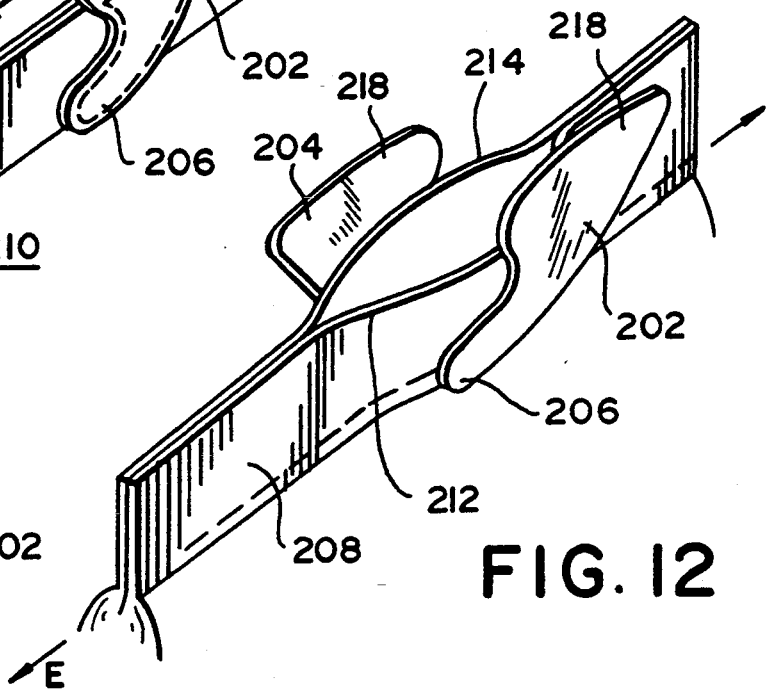
FIG. 12
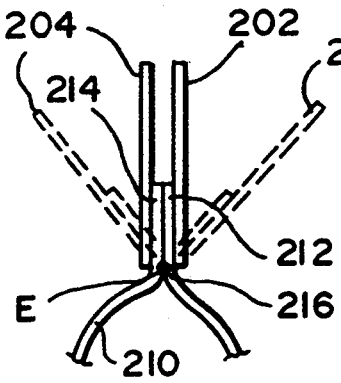
FIG. 13

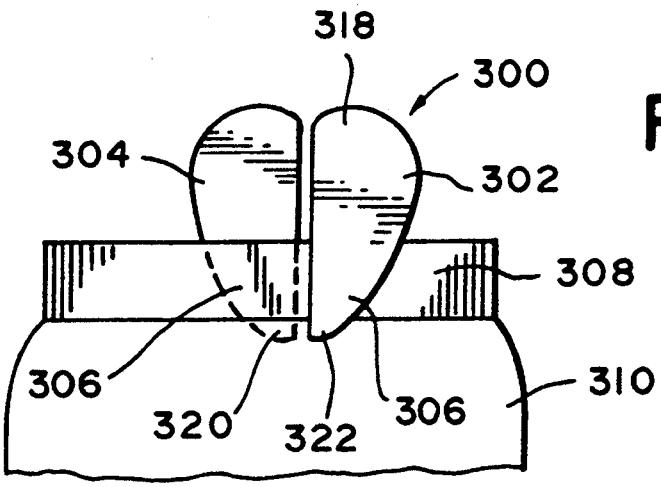
FIG. 14
FIG. 15
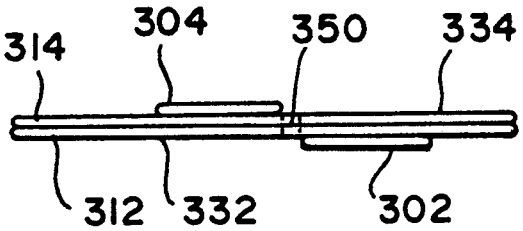
FIG. 16
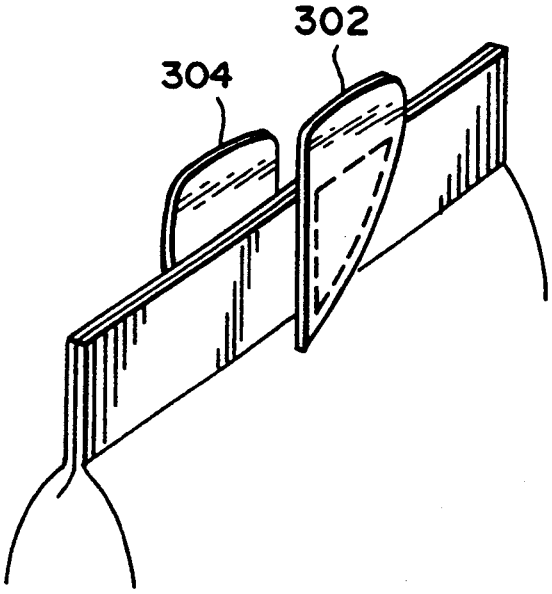
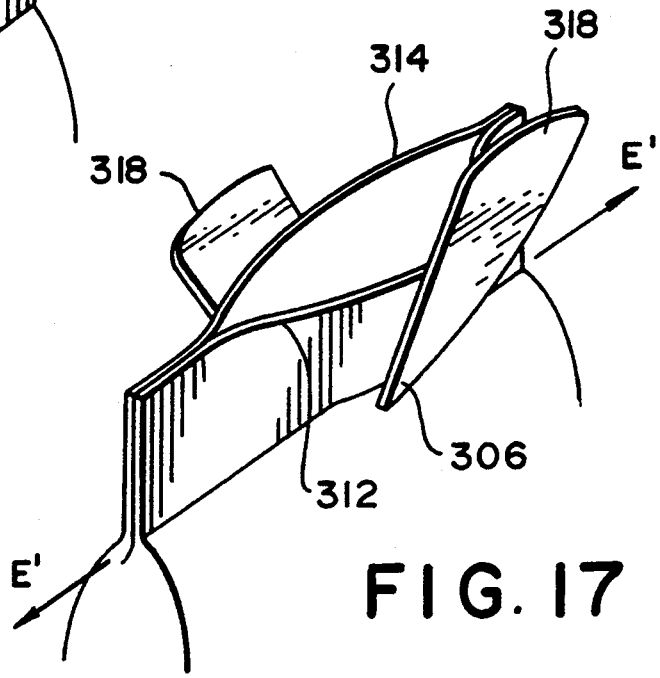
FIG. 17
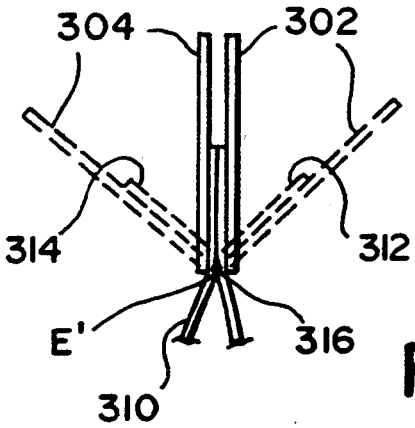
FIG. 18

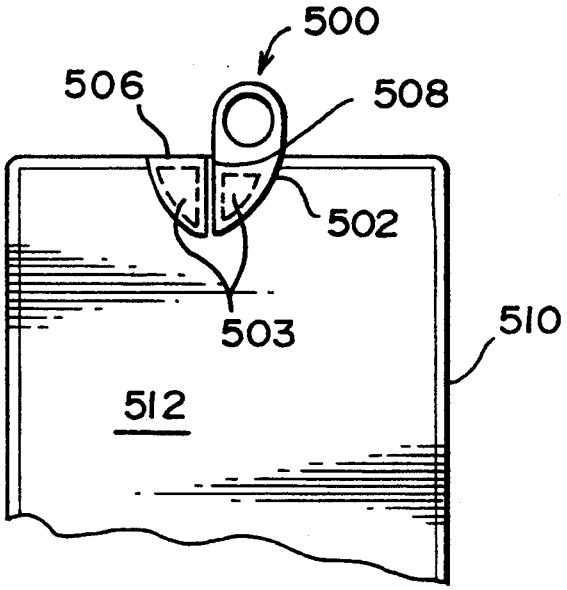
FIG. 21
FIG. 22
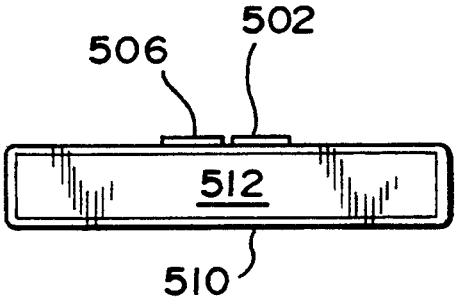
FIG. 23
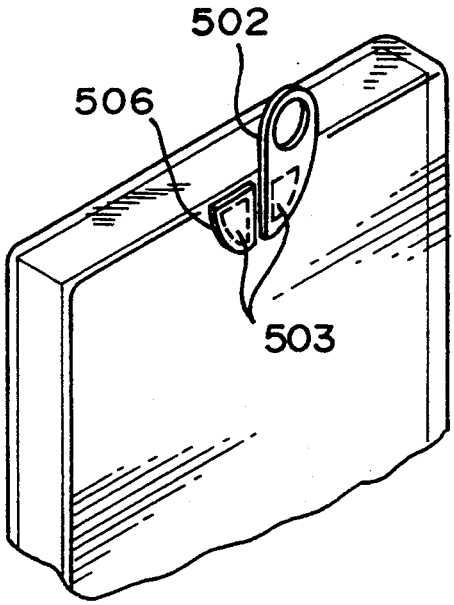
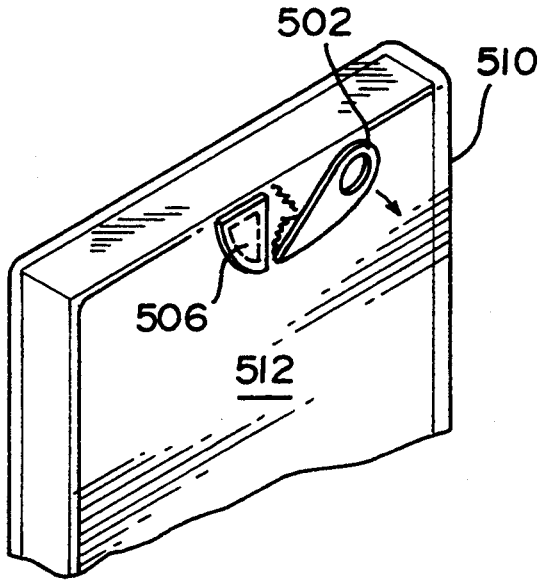
FIG. 24

OPENING DEVICE FOR FLEXIBLE PACKAGING

CROSS-REFERENCE TO RELATED APPLICATIONS

The present application is a continuation-in-part of application Ser. No. 07/863,016, filed Apr. 3, 1992, now U.S. Pat. No. 5,215,381, which is a continuation-in-part of application Ser. No. 07/510,203, filed Apr. 17, 1990, now U.S. Pat. No. 5,127,065.

BACKGROUND OF THE INVENTION

1. Field of the Invention

The present invention relates to devices which are fastened to flexible packaging to assist in tearing open the packaging without the use of an additional tool.

2. Description of Related Art

A major consideration in designing packaging for various consumer products is the manner in which the packaging may be opened by the end user of the product. As an example, steel and aluminum cans have long been used to contain individual servings of carbonated and non-carbonated beverages. Initially, such cans required the use of an additional tool, the can opener, to pierce an opening or openings in the lid portion of the can in order to extract the beverage. A significant disadvantage associated with this type of packaging was that can openers were not always readily available when a person wished to open the can.

Recognizing this disadvantage, package designers developed the "flip-top" can, which now enjoys widespread use in individual serving sized cans. The flip-top employs the physical principles of leverage and isolation of stressed material to eliminate the need for an additional tool, such as the can opener, because a leveraging means and a weakened region of the lid are provided on each can. Consumer reaction to this and other improvements, however slight, in package opening convenience has been so overwhelmingly positive that it is presently difficult to find cans or boxes requiring additional tools to open them.

In the field of flexible packaging, e.g., polymeric bags, however, one often finds that opening the package requires a separate or additional tool such as a pair of scissors, a knife, or one of numerous tools sold for the express purpose of performing the package opening function. While most flexible packaging for consumer goods is ostensibly designed to be opened with normal manual effort, in reality many of these packages require near-superhuman effort to effect the opening of the package, and many consumers thus resort to the use of an opening tool.

Numerous approaches have been taken to alleviate the problem of opening bag-type flexible packaging without the need for an additional tool. Slits or v-notches have been provided on the edges of packages in order to provide a tear initiation site, which overcomes one problem associated with the opening of flexible packaging. Some packaging designs have employed a weakened line of material extending through the package which is somewhat similar in concept to scoring the lid of a flip-top can in that the weakened line provides a "path of least resistance" for tear propagation, and tends to concentrate tearing stresses in that region. It should be readily apparent that employing weakened lines in the packaging material has the disadvantage that the package might be inadvertently opened in the transportation or handling of the packages prior to reaching the end user.

Tear strips or tear strings have also been employed in flexible packaging in order to avoid the necessity of using an opening tool. The use of tear strips or tear strings often complicates the packaging operation itself, thereby driving up the product manufacturing cost, which is ultimately passed on to the consumer. Finger or hand grasping means have previously been employed in attempts to facilitate the opening of flexible packaging. The grasping means previously employed have generally been integral extensions of the packaging material itself, or exposed extensions of tear strips or tear strings. Such grasping means, while improving the ability to apply tearing forces to the package, have not provided any substantial force magnification or stress concentration which would ease the opening of the package.

It is therefore an important object of the present invention to provide an opening device which is fixedly attached to a flexible packaging container, and which provides multiplication of tearing forces and concentration of tearing stress in an isolated region of the packaging to facilitate the opening of the packaging by exertion of manual force.

It is a further important object of the present invention to provide an opening device which is to be fixedly attached to a flexible packaging container and which comprises a pair of closely spaced wing-like members or levers, the distal ends of which extend from a peripheral edge of the packaging, the wing-like members having a common fulcrum at their proximal ends wherein a proximal end portion of each wing is secured to the packaging.

It is another important object of the present invention to provide a flexible package opening device made of a relatively inexpensive material and which is further easily secured to the flexible package as the package is formed and sealed, the opening device providing means for concentrating and isolating tearing stresses at a predetermined narrow region of the package and a means for increasing a tearing force exerted by a person opening the package.

It is an additional object of the present invention to provide a device to be secured to a flexible packaging material which provides magnified application of tearing forces through leverage and concentration of the tearing forces at a predetermined area, which device takes advantage of the ability of the contents of the package to provide a bearing surface against which a proximal end of the device secured to the packaging material will pivot as a fulcrum.

SUMMARY OF THE INVENTION

The above and other objects of the present invention are accomplished by providing an opening device comprising a substantially rigid pair of wing-like members joined at a proximal end by an integral web, the pair of plastic wings being closely spaced from one another and defining a narrow slit therebetween. The web and a portion of the length of each wing-like member are secured or fixedly attached to a package made of flexible material, and the distal ends of the wings extend outwardly from a peripheral edge of the package. The opening device is fixedly attached to the package during the packaging and sealing process by heat sealing the device to the package material in the desired location or by other suitable attachment means.

The device assists in opening the package by providing increased leverage in applying tearing forces, as well as providing an isolation of a narrow region of flexible material in the space between the two wings, which focuses or concentrates the tearing forces and stresses in that region of the package. A person desiring to open the package may grip each of the substantially rigid wing-like members near the distal ends thereof between a thumb and forefinger, and may simply move or rotate the members relative to one another out of the plane in which the wing-like members are originally disposed. Because the members are substantially rigid and are hinged together by the web at a proximal end of the device, the web acts as a fulcrum point, and additional leverage is provided, as the force applied by the person opening the package is applied at a greater distance than if he or she were grasping the bag directly at the peripheral edge. Further, the tearing forces are focused or concentrated only in the narrow slit region between the wing-like members because the package and the device are secured together along a portion of the length of the wing-like members.

The increased leverage and the concentration of tearing stresses will initiate and begin the propagation of a tear in the peripheral edge of a wide variety of flexible packaging materials. As the distal ends of the wing-like members are moved or rotated farther apart relative to one another, the tear propagates inwardly from the peripheral edge of the package toward the proximal ends of the wing-like members and the web connecting the members. The opening device is designed and is secured to the package in such a manner that the web will fracture just prior to or substantially concurrently with the leading edge of the propagating tear reaching that point, due to the increased stress in that area resulting from the increased separation between the distal ends of the opening device.

As indicated previously, the opening device may be heat sealed or otherwise securely adhered to one of the outer surfaces of the package at a selected peripheral edge of the package. Alternatively, the device may be sealed or securely adhered between two mating inner surfaces of the peripheral portions of the package which are themselves sealed together in sealing the package. The device thus provides an inexpensive and reliable means for opening flexible packaging which eliminates the need for an additional tool in opening the package.

The device alternatively comprises a substantially rigid pair of levers or wing-like members, the proximal ends of which are attached to opposite sides of a package seal such that the proximal ends are in sufficiently close relationship to form a common fulcrum at the innermost portions of the proximal ends.

Another alternative variation on the device will employ only a single lever secured to the flexible packaging. In this variation, the packaging material will fairly closely conform to the contents portion of the package, and the contents portion itself will be of a character such that it will provide an opposing force to fix a point about which the proximal end of the lever will rotate when the distal end of the lever is gripped and pulled away from the surface of the packaging material.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention, taken in conjunction with the accompanying drawings wherein like reference characters represent like parts throughout the several views.

FIG. 9 is an elevation view of a further alternative preferred embodiment of the opening device and package of the present invention.

FIG. 10 is a top plan view of the device and package of the FIG. 9 embodiment.

FIG. 11 is a perspective view of the FIG. 9 embodiment prior to the device being used to open the package.

FIG. 12 is a perspective view of the FIG. 9 embodiment after the device has been used to initiate the opening of the package.

FIG. 13 is a side view of the opening device of FIG. 9 and the portion of the package to which the device is secured.

FIG. 14 is an elevation view of a further alternative preferred embodiment of the opening device and package of the present invention.

FIG. 15 is a top plan view of the device and package of the FIG. 13 embodiment.

FIG. 16 is a perspective view of the FIG. 13 embodiment prior to the device being used to open the package.

FIG. 17 is a perspective view of the FIG. 13 embodiment after the device has been used to initiate the opening of the package.

FIG. 18 is a side view of the opening device of FIG. 14 and the portion of the package to which the device is secured.

FIG. 21 is an elevation view of another preferred embodiment of the opening device of the present invention.

FIG. 22 is a top plan view of the FIG. 21 embodiment.

FIG. 23 is a perspective view of the FIG. 21 embodiment.

FIG. 24 is a further perspective view of the FIG. 21 embodiment after the device has been used to initiate the opening of a package.

DETAILED DESCRIPTION OF THE PREFERRED EMBODIMENTS

Figure 1:
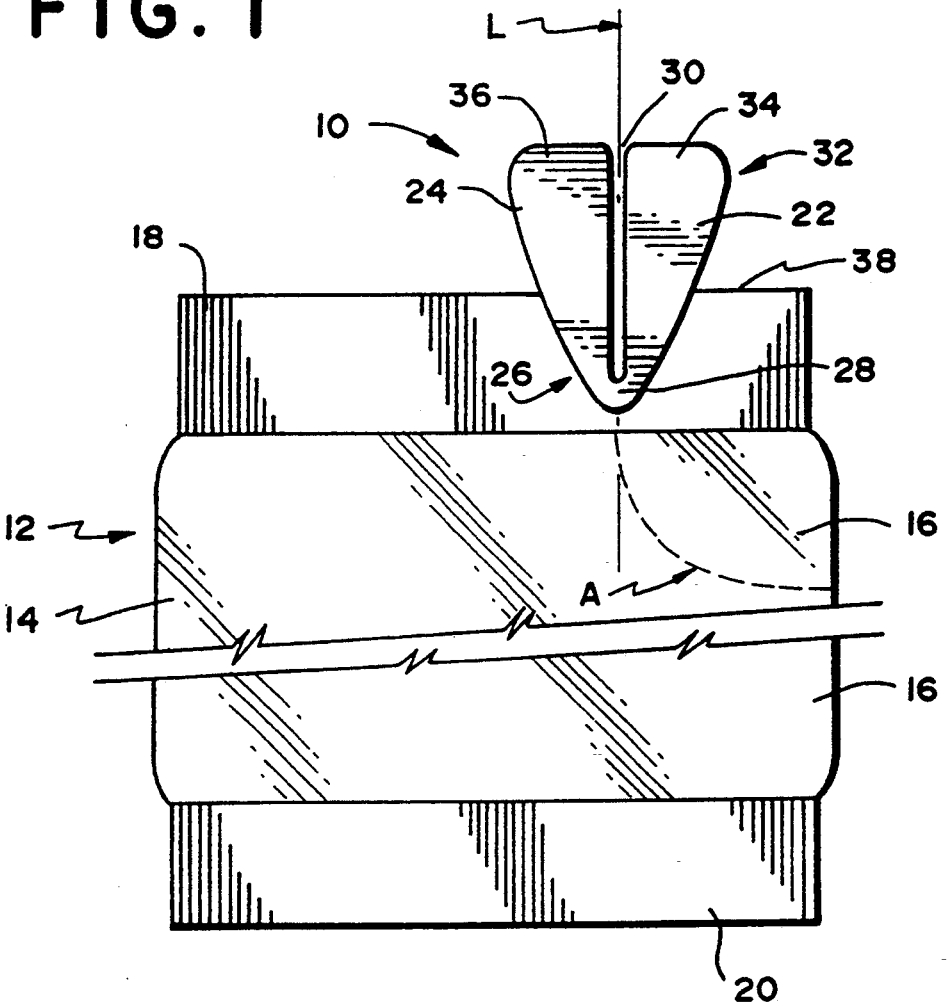
FIG. 1 is an elevation view of the opening device according to a preferred embodiment of the present invention, secured in position to a flexible package.

Referring initially to FIG. 1, an opening device 10 according to a preferred embodiment of the present invention is shown secured to a package 12 made of a flexible packaging material. The opening device 10 is preferably securely fastened or adhered to the package in any one of several ways which will be discussed later in the specification. The device 10 of the present invention is suitable for use with most, if not all, types of packaging materials and package designs which are designed to be torn open to gain access to the contents of the package. Examples of the types of packaging materials with which the device 10 is suitable for use include polyurethane, polyethylene, and other polymeric bag materials, thin foil type sealed packages, heavier weights of paper not easily torn by hand, and foil lined polymeric or paper packaging materials, hereafter referred to as flexible packaging materials. The above list is not, however, to be regarded as all-inclusive, and is provided only to show examples of those types of materials which fall under the collective name "flexible packaging materials".

In the preferred embodiment of FIG. 1, the device 10 is secured to a sealed bag 14, which may be made of polyurethane or the other materials listed above. As is typical of such bags, a sheet of the material forms a contents section 16 of the bag, and the bag is sealed in an airtight manner at an upper sealed end 18 and a lower sealed end 20, forming an enclosure completely around the contents.

The opening device 10 comprises a pair of wing-like members, hereinafter referred to as first wing 22 and second wing 24, joined at a first end, hereinafter termed a proximal end 26 of the device, by a web 28. First and second wings 22, 24, which are preferably sized to accommodate the pads of the index finger and thumb of the user (FIGS. 3, 4), are spaced apart at a narrow predetermined distance by a slit 30 extending from web 28 to a distal end 32 of the opening device 10. The device as shown is substantially symmetrical about a longitudinal axis L extending in the direction of and bisecting the space defined by slit 30.

As can be seen in FIG. 1, preferably only a portion of the opening device 10 is secured to the bag 14, thereby positioning the distal ends 34, 36 of first and second wings 22, 24 to extend outwardly from an upper peripheral edge 38 of the bag. It is preferred that the device 10 be secured to the bag 14 along approximately one-third to one-half of the full length of the device. In the FIG. 1 embodiment, the device is secured to the bag on the upper sealed end 18 thereof, and the slit 30 is oriented such that if the slit were extended inwardly away from the upper peripheral edge of the bag 14, the slit would eventually reach a point at which upper sealed end 18 meets the contents section 16 of the bag. It is possible, if desired, to provide an opening device 10 having sufficient length such that the proximal end 26 of the device actually extends completely across the sealed end 18 of the bag, and onto an exterior surface of the contents section 16 of the bag.

The device serves as a means for initiating and propagating a tear in the package through the sealed end, and into the contents section 16, and in the FIG. 1 orientation is preferably used to tear off a corner portion of the contents section, as indicated by broken line A.

Figure 2:
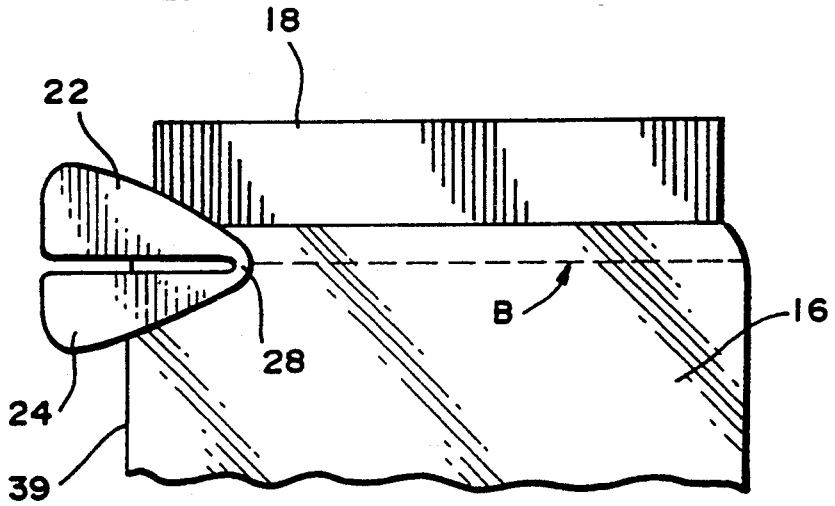
FIG. 2 is an elevation view of the opening device of the present invention secured in an alternate position to a flexible package.

The FIG. 2 embodiment of the opening device 10 of the present invention differs from that of FIG. 1 substantially only in the positioning of the device on bag 14. In this Figure, the device 10 is affixed to the bag in a position adjacent the sealed end 18 of the bag, and at a peripheral edge 39 of the contents section 16 of the bag, wherein the slit 30 extends in a direction extending through the contents section, and preferably parallel to the upper sealed end 18 of the bag. When positioned in such an orientation, the device 10 may be used to initiate and propagate a tear in the package across a top portion thereof, as indicated by broken line B. It is to be recognized from viewing FIG. 2 that the term peripheral edge is used herein not only to refer to a sealed end of a bag 14, such as that shown in FIG. 1, but also to refer to any peripheral boundary of a bag or other type of package.

The operation of the opening device 10 will be discussed by referring particularly to FIGS. 3–5. The present invention was developed in recognition of the fact that the initiation and initial propagation of a tear in the flexible packaging is the largest obstacle in opening a package. As indicated previously, the initiation and initial propagation of a tear in many instances requires the use of a knife, scissors or other sharp object. The opening device 10 of the present invention obviates the need for a separate instrument by providing added leverage and concentration of the tearing forces, such that the package can be opened by hand.

Figure 3:
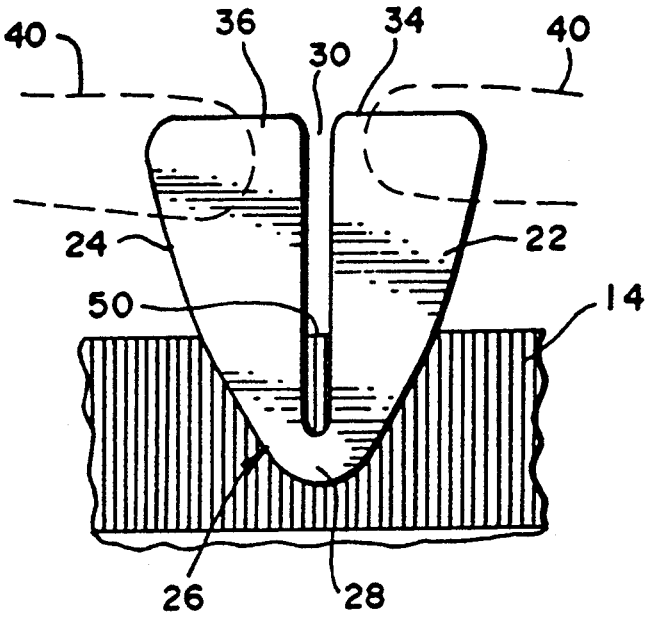
FIG. 3 is an enlarged elevation view of the opening device and the edge of a flexible package to which the opening device is secured.
Figure 4:
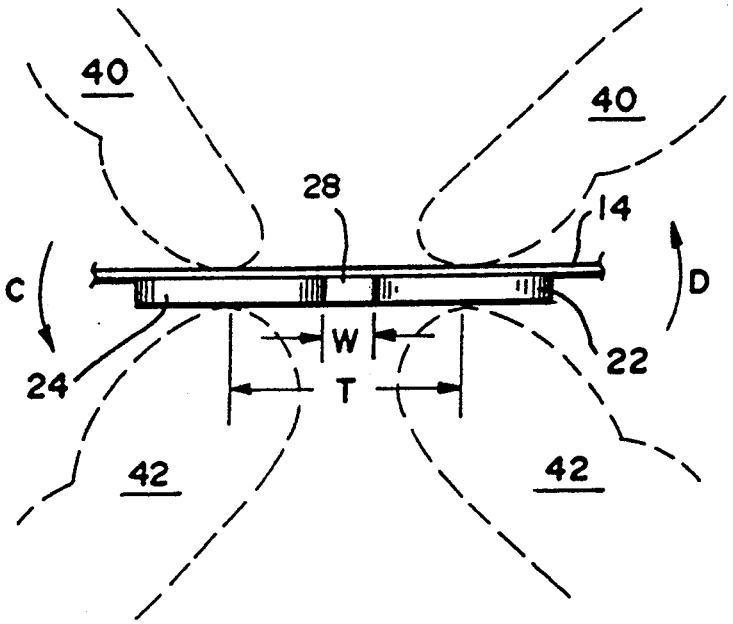
FIG. 4 is a top plan view of the opening device and a portion of the flexible package prior to use.

As can be seen in FIGS. 3 and 4, the first and second wings 22, 24 of the device are preferably sized to provide a gripping surface for a person's fingers 40 and thumbs 42 (broken lines). The wings 22, 24 are gripped between a finger, preferably the index finger, and thumb of each hand. The first and second wings 22, 24 preferably are initially disposed in a flat planar arrangement, as shown in FIG. 4.

Figure 5A:
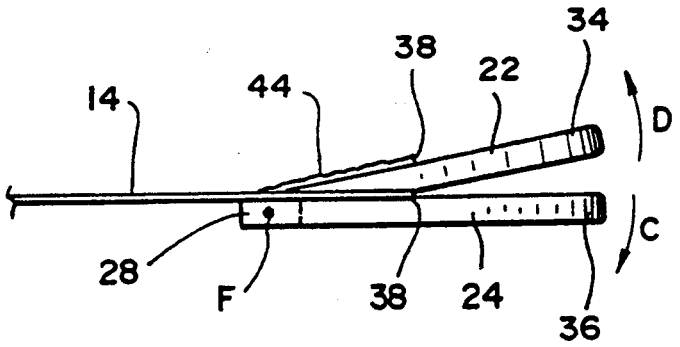
FIGS. 5 *a, b* are side views of the opening device and a portion of the flexible package at an earlier and a later stage, respectively, of using the opening device to initiate the opening of the package.
Figure 5B:
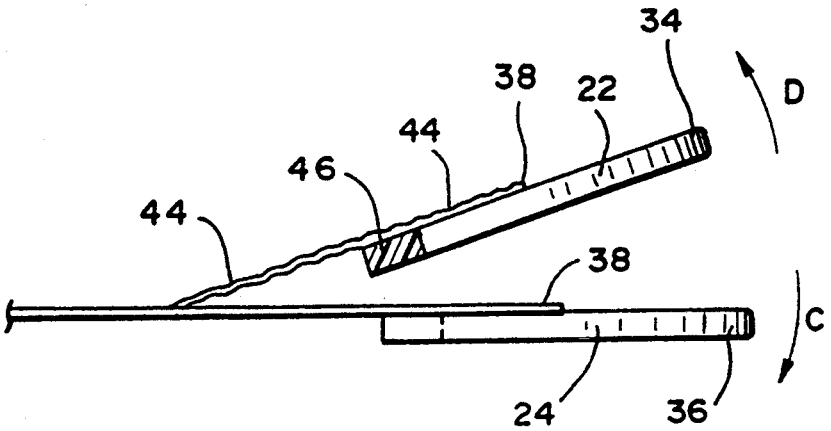

In initiating a tear in the package, the first and second wings 22, 24 are moved relative to one another out of the planar configuration in which they are initially disposed, as indicated by directional arrows C, D (FIGS. 4, 5). Because the wings 22, 24 are initially joined at their proximal end by web 28, the wings each act as levers which are rotated about the web 28, which itself serves as the fulcrum point F (FIG. 5*a*) for each of first and second wings 22, 24.

As can be seen in FIG. 5*a*, first wing 22 and second wing 24 are rotated relative to one another about fulcrum point F, and the portion of the package or bag 14 disposed in the region of slit 30 is sheared to initiate a tear 44 at a peripheral edge 38 of the bag. As the first wing 22 and second wing 24 are rotated further about fulcrum point F, the tear 44 propagates inwardly from peripheral edge 38 toward web 28. The opening device 10 is preferably made of a substantially rigid material, so that wings 22, 24 will properly act as levers in assisting the opening of the bag 14.

In addition to being made of a substantially rigid material, the opening device 10 is also preferably constructed such that the web 28 will break apart at fracture area 46 (FIG. 5*b*) as the distal ends 34, 36 of wings 22, 24 are rotated farther apart from one another. The fracture 46, which separates first wing 22 from second wing 24, will preferably occur in the web just prior to or at the same time as the tear 44 in the bag 14 has propagated to the region of the bag to which web 28 is secured. An opening device designed in this manner allows the wings 22, 24 to provide the increased leverage desired to initiate the tear 44 and to promote the initial propagation of the tear, while at the same time allowing the unobstructed continuation of the tear 46 (FIG. 5*b*), to complete the opening of the package. Once the fracture 46 has occurred, the first wing 22 and second wing 24 may be moved independently of one another, allowing a larger tear to be made.

The desired fracture characteristics of web 28 in opening device 10, are affected by several factors related to the configuration and the material properties of the device. The shape, size, and thickness of the device, including the slit and web configurations, will preferably be closely matched with the strength, rigidity and brittleness of the material from which the device is made such that the fracture will be accomplished at the desired point under average effort or exertion by the person opening the package.

The action of first and second wings 22, 24 as levers increases the shearing force on the package material over that produced by gripping the peripheral edge 38 of the bag with one's thumbs and forefingers alone and applying a tearing or shearing force to the bag. By positioning the opening device 10 such that the distal ends 34, 36 of first and second wings 22, 24 extend outwardly away from the peripheral edge 38 of the bag, while the web 28 comprising the fulcrum is located on the opposite (inner) side of peripheral edge 38, a second-class lever is created. Thus, the mechanical advantage provided by first and second wings 22, 24 in tearing the peripheral edge 38 of the bag increases as the length of the distal ends 34, 36 extending from the peripheral edge 38 is increased. As depicted in FIG. 3, a preferred positioning of the device 10 relative to the peripheral edge 38 of the package 14 leaves approximately two-thirds of the overall length of opening device 10 extending outwardly from the peripheral edge, leaving approximately one-third of the length secured to the package. Such a positioning approximately triples the amount of shear experienced at the peripheral edge of the package, as compared with gripping the package directly, for the same amount of effort employed by the person attempting to open the package.

The ability to initiate and propagate a tear in the package is further improved by concentrating or confining the shearing forces at the portion 50 (FIG. 3) of the peripheral edge of the package between the first wing 22 and second wing 24, i.e. the area defined by slit 30. As depicted in FIG. 4, the width dimension W of the slit 30 is substantially smaller than the width dimension T that is achievable between the thumbs 42 in a comfortable gripping position directly on the package itself. The slit, which may preferably be of a width on the order of 1–2 mm, or possibly even narrower, may be as much as four times narrower than the distance between the thumbs in a comfortable gripping position. The resulting concentration of forces thus substantially reduces the effort required to initiate a tear at the peripheral edge of the package.

The opening device 10 as depicted in FIGS. 1–5 is preferably joined to the bag 14 or other type of package made of flexible packaging material, and particularly polymeric packaging materials, by heat sealing the proximal end 26 of the opening device 10 to the surface of the bag 14 at the desired peripheral surface thereof. The application of a sufficient amount of heat and pressure to the device 10 and the peripheral edge of the bag 14 will substantially irreversibly bond the device 10 to the bag 14, and is believed to be a suitable process for achieving the necessary irreversible bond for many of the packaging materials and opening device materials anticipated for use in connection with the present invention.

Other methods for obtaining the necessary bond between the device and the package may be employed should heat sealing prove to be impracticable or uneconomical for certain package materials or opening device materials. An adhesive, such as a urethane or an epoxy adhesive may be employed, for example, in securing or bonding an opening device 10 to polyethylene packaging materials. The surface of the polyurethane may optionally be treated in order to further improve the adhesion of the device to the packaging material, a proposed surface treatment comprising cleaning the surface with isopropyl alcohol or acetone, lightly abrading the surface with sandpaper or wire brush, and dipping the area into a heated solution of sulfuric acid/potassium dichromate/water for a short period of time, such as 30 seconds. Other candidate adhesives, depending on the type of packaging material and opening device material employed, include hot melt glues of an ethylene-vinyl acetate or ethylene-ethyl acetate copolymer compositions.

The material from which the opening device 10 is made is preferably selected for both its mechanical properties and its adhesive qualities, including its compatibility with the type of packaging material being employed. A preferred candidate material is crystal styrene, which possesses good strength and rigidity, good brittle fracture characteristics, good adhesive qualities, and low material cost. Other materials which may be suitable for use as the opening device include ABS (acrylonitrile butadiene styrene) plastics, PBT (polybutylene terephthalate) plastics, polyacrylate and polycarbonate.

Figure 6:
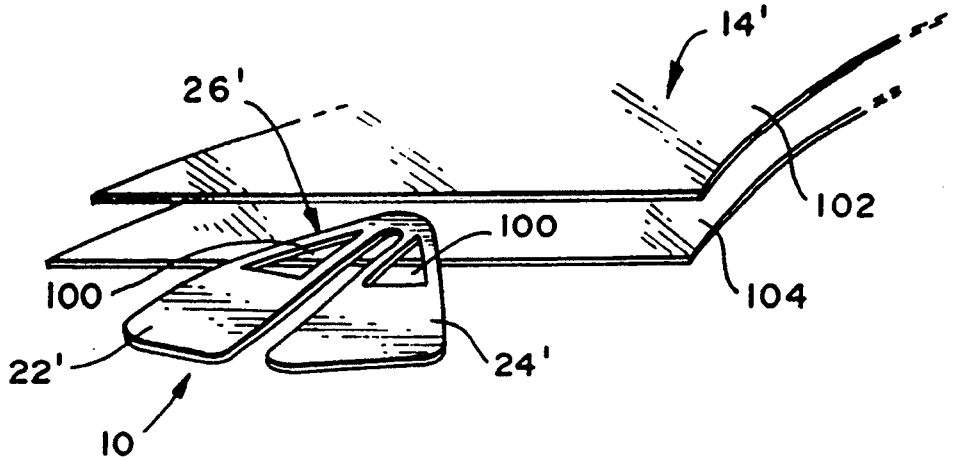
FIG. 6 is a perspective view of an alternative preferred embodiment of the opening device of the present invention and two portions of the flexible packaging to which the device is to be secured.

In some instances, it may be desired to employ a type of flexible packaging material and a opening device material which are incompatible from the standpoint of obtaining a high-quality reliable bond between the materials. In such instances, an alternative embodiment of the opening device of the present invention may be secured to the flexible packaging material using alternative means for holding the device in place. FIG. 6 depicts such an alternative embodiment of the opening device 10′, wherein each of a first and second wings 22′, 24′, have a cutout section 100 disposed at the proximal end 26′ of the device. When configured in this manner, the device 10′ may be inserted between two edges 102, 104 of the bag 14′ prior to the sealing of the bag, and when the bag edges 102, 104 are heat-sealed or otherwise-sealed together, the bag edges will also seal in the areas left open by cutout sections 100. The proximal end 26′ of opening device 10′ will thus be encased by and captively retained between the sealed edges 102, 104 of the bag 14. The opening device 10' is used to initiate a tear in the bag in the same manner as described with respect to the FIGS. 1–5 embodiment of the opening device.

Figure 7:
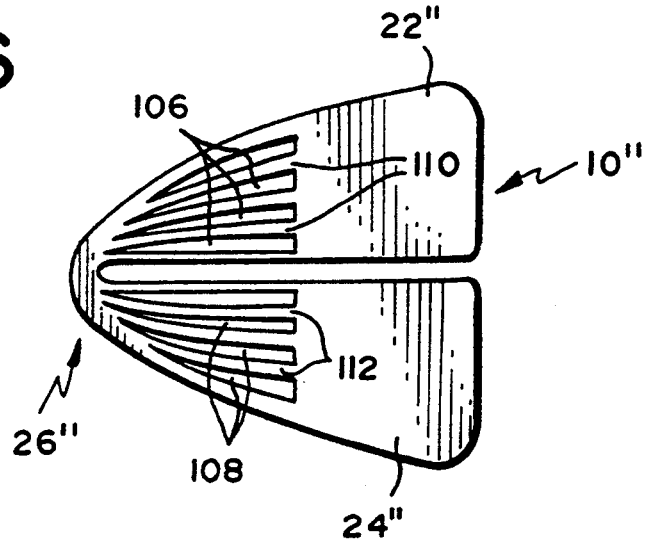
FIG. 7 is an elevation view of an alternative preferred embodiment of the opening device of the present invention.

FIG. 7 depicts a further alternative preferred embodiment of an opening device 10" in accordance with the present invention. Each of first and second wings 22", 24" is provided with a plurality of cutout sections 106, 108, separated by splines 110, 112, the open areas created by the cutout section serving essentially the same purpose as those in the FIG. 6 embodiment, namely to provide open area in the proximal end 26" of each wing through which the flexible packaging material is permitted to seal upon itself. The FIG. 7 embodiment is believed to provide increased concentration of tearing forces on the peripheral edge of the bag as compared with the FIG. 6 embodiment, and would thus be preferred if the additional concentration of forces is believed to be necessary or desirable in a particular application.

Figure 8:
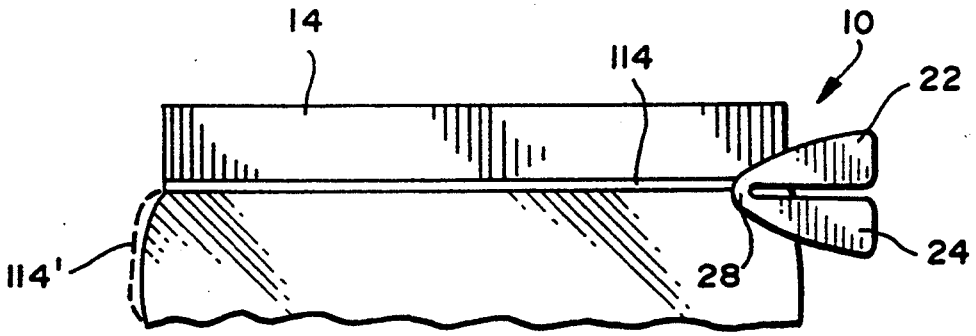
FIG. 8 is an elevation view of an alternative preferred embodiment of the opening device and package of the present invention.

FIG. 8 depicts an alternative preferred embodiment of the opening device 10 of the present invention which is especially well suited for use with more durable flexible packaging materials such as freeze-dried coffee packs or dog food bags currently found in the marketplace. In this embodiment, first wing 22 has a tear string 114 attached at its proximal end. The tear string 114 may preferably be embedded in the packaging material or otherwise attached to the packaging material in a manner known in the art, and will extend across a predetermined portion of the packaging material where it is desired to effect a tear.

In this embodiment, the opening device 10 is operated in the same manner as with the previously described embodiments, and upon achieving fracture at web 28, first wing 22 may be further pulled to initiate the operation of the tear string 114 in propagating a tear across bag 14. The tear string 114 operates in a manner known in the art to concentrate shearing or tearing forces along the string in facilitating the opening of bag 14. The use of the tear string in combination with the opening device provides the ability to initiate a tear and to propagate a tear through tougher and more durable packaging materials using normal human effort without requiring resort to separate cutting or opening tools. The tear string 114 may preferably be made of a fishing line material such as nylon, or other suitable polymeric line materials. The tear string 114 could also have an additional portion 114', firmly attached to the bag beyond the area of expected tearing, the object being to reduce consumers' inadvertent littering by designing the bag to not separate into two sections after a tear is effected to gain access to the bag's contents (FIG. 8).

FIGS. 9–17 depict two further preferred alternate embodiments of the opening device of the present invention which are particularly useful when the opening device is to be secured to a sealed edge of a bag. In these embodiments, the rigid wing-like members or levers are not physically connected by an integral web, as in the foregoing embodiments, but the wing-like members or levers are connected to one another by way of the package material to which the levers are attached. The levers are attached to the package such that they will operate about a common fulcrum to provide increased tearing force to facilitate the opening of a package.

In FIGS. 9–13 the flexible package opening device 200 is depicted as a pair of levers, designated as a first lever 202 and a second lever 204. Each of these levers has a proximal end 206 secured to a sealed edge 208 at the periphery 209 of a flexible package 210. The sealed edge will usually be formed by sealing together, in any conventional manner, a first and second layer 212, 214 (FIGS. 10–12) of the sheet-like package material. The first lever 202 is secured, as by heat sealing or other means discussed earlier in the specification, to the first layer 212 of the sealed edge, and the second lever 204 is secured in a similar manner to the second layer 214 of the sealed edge.

The outwardly facing surface of first layer 212 will also be referred to as front surface 232, and the outwardly facing surface of second layer 214 will alternatively be referred to as back surface 234. As can be seen especially in FIGS. 10–13, the levers 202, 204 can be described as being secured to opposite sides (the front and back surfaces) of the sealed edge 208 of the package 210. In certain instances, the sealing of layers 212, 214 may be so complete as to fuse the layers together, making it impossible to distinguish one layer from the other. In this case, the sealed edge 208 will still retain a front surface 232 and a back surface 234.

As seen in FIG. 9, the proximal ends 206 of first and second levers 202, 204, are secured to the package such that there is a physical overlap at the innermost portions of the proximal ends when viewed from a direction perpendicular to a plane (the plane of the paper) in which the sealed edge 208 lies. This overlap of the proximal ends 206 of the levers 202, 204 provides each of the levers with an abutting surface for the other lever, giving the device a common fixed point, or common fulcrum 216 (FIGS. 9–13), substantially at the innermost portions 220, 222 of the proximal ends 206, about which the levers can be rotated to assist in opening the package.

FIGS. 12 and 13 best illustrate that the device 200 is employed to open the package by rotating the distal ends 218 of the levers 202, 204, away from each other about an axis E extending through fulcrum 216 in a direction along the extent of the sealed edge 208 of the package. The solid lines in FIG. 13 show the initial positions of the levers 202, 204 and layers 212, 214 of the sealed edge of the package, and the broken lines in that figure show the positions of those elements after the device has been used to initiate an opening in the package. As can be seen in those figures, the depicted opening of the package is by tearing the layers of the sealed edge apart from one another.

In the situation previously mentioned wherein the layers 212, 214 are completely fused so as to form a single sealed layer, the opening device 200 may operate to create a tear in the sealed edge between the levers instead of separating the sealed layers from one another as shown in FIGS. 12–13. In fact, the opening device is capable of operating in that mode whenever the adhesion forces between the layers are greater than the shear strength of the material at the sealed edge. Tearing forces in this embodiment are increased by the action of the levers, and are concentrated at only the portion of the sealed edge designated by numeral 250. As such, the device greatly facilitates opening the package.

Turning now to FIGS. 14–17, a variant on the opening device of FIGS. 9–13 is depicted. The opening device 300 is similar in many respects to opening device 200, with the principal exception that there is no physical overlap (see FIG. 14) of the first and second levers 302, 304, when the package and device are viewed in a direction perpendicular to a plane (the plane of the paper) in which the sealed edge 308 of the package lies. It has been determined, in connection with the development of the present invention, that the proximal ends 306 of the first and second levers 302, 304, need not have an actual area of overlap, as is present in device 200 of FIG. 9, in order for the device to have and to operate about a common fulcrum. The first and second levers 302, 304 need only be spaced sufficiently closely together (FIG. 14) such that the proximal ends 306 of the levers coact with the package material disposed between the levers (FIG. 15) such that a common fixed point or common fulcrum 316, about which the levers 302, 304 will rotate, is maintained. The preferred spacing is on the order of 1 mm or less. If the spacing is much larger than a couple of millimeters, the levers will not likely be able to form a common fulcrum with the packaging material extending between the innermost portions of the proximal ends of the levers, due to the increased freedom of movement permitted by the greater amount of packaging material between the levers.

The opening device 300 is operated in the same manner as is device 200 to open a package. The distal ends 318 of the levers are rotated in opposite directions about axis E' extending in the direction of the extent of sealed edge 308 of the package 310. As can best be seen in FIG. 18, this outward rotation of the distal ends of the levers urges the innermost portions 320, 322 of the proximal ends 306 of the levers inwardly toward each other. The packaging material disposed between the innermost portions 320, 322 of the proximal ends of levers 302, 304, is restricted from substantial movement by the opposing forces exerted by the proximal ends, and the material itself restricts further movement of the innermost portions of the proximal ends of the levers. The levers 302, 304 thus operate about a common fixed point, or common fulcrum 316, to provide the force multiplication at the distal ends 318 of the levers 302, 304, which act on layers 312, 314 to separate the layers from one another or to create a tear in the sealed edge of the package. In this embodiment wherein the levers do not overlap, these multiplied forces act on substantially only a very small portion of the sealed layers, designated in FIG. 15 by numeral 350, as this is the portion of the sealed edges where the opposing separation forces are concentrated.

FIG. 18 further shows that, even when the innermost portions 320, 322 of the proximal ends 306 of levers 302, 304 extend inwardly past the sealed edge 308 of the package, the levers 302, 304 will act about a common fulcrum once the freedom of movement of the unsealed package material is eliminated by the opposing forces of the proximal ends 306 of the levers.

Although the devices in the embodiments of FIGS. 9–18 are capable of altering the manner in which the package is opened (layer tearing) from that when the devices of FIGS. 1–8 are employed, these embodiments share several of the same advantages for opening flexible packages. The provision for a pair of two levers 202, 204; 302, 304, operating about a common fulcrum 216, 316 gives these devices the ability to increase or multiply the forces required to open the package to gain access to the contents thereof. The use of distal end sections of the levers which are not secured to and extend free of the package provides a very convenient gripping means which enables easy operation of the levers. The overlap or close spacing of the two levers concentrates the forces operating to separate the sealed layers or to tear the sealed edge at a relatively small area of the edge of the package, which further increases the effectiveness of the forces multiplied by the levers.

In the embodiment depicted and described with respect to FIGS. 9–18, it is desired that the levers 202, 204; 302, 304 be heat sealed to the sealed edge of the package over a majority of the area at which the proximal ends contact the sealed edge. Alternatively, it is desired to heat seal the proximal ends of the levers to the edge of the package roughly along the outline of the area of contact of the proximal ends and the sealed edge, as shown by the broken lines in FIGS. 11 and 16.

FIGS. 19–24 depict further variants of the present invention, and comprise alternative preferred embodiments thereof. In these embodiments, the feature wherein a pair of levers acting around a common fulcrum to increase tearing forces is replaced with essentially a single lever which operates to concentrate tearing forces at a point nearest to the distal end of the device where the device is bonded to the packaging material.

Figure 19:
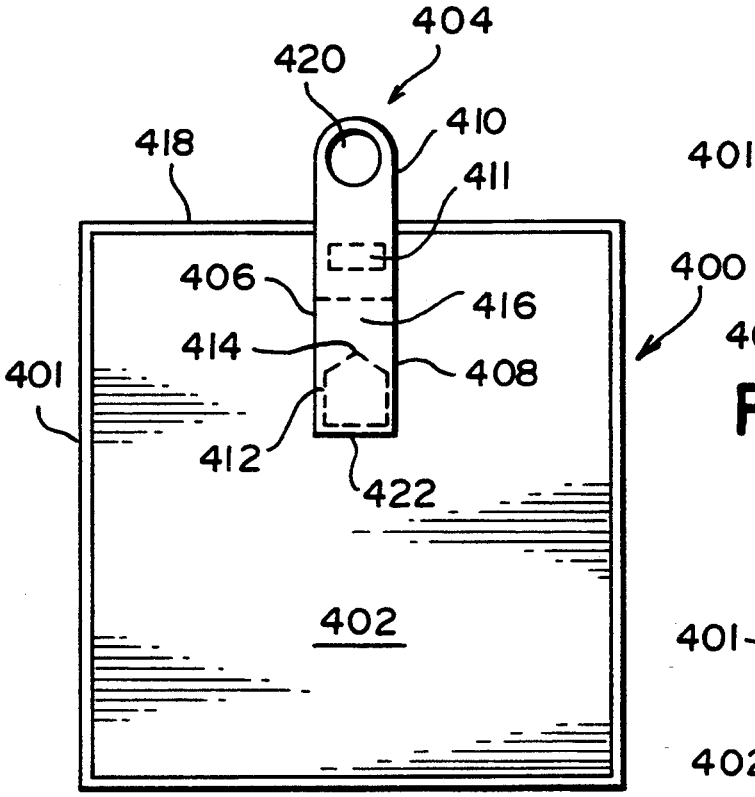
FIG. 19 is an elevation view of a further alternative preferred embodiment of the opening device and package of the present invention.

Turning first to FIG. 19 and FIGS. 20 A–D, a package 400 is provided in the form of a packaging material 401 which closely conforms to the shape of the contents 402 of the package. This embodiment, as will be discussed later, is particularly well-suited for use with packaging containing single items, such as a deck of cards, in a shrink packaging material, such as an oriented polyethylene film. This embodiment is also well suited for use with packaging containing more than one item, provided the product (herein used to refer to both single and multiple items) is capable of providing a bearing surface against which and about which an end of the opening device may pivot.

The opening device 404 in this embodiment preferably comprises a single lever arm 406 having a proximal portion 408 which is stiff or rigid such that it will perform the function of a lever arm, and a distal portion 410 extending from the proximal portion 408, the distal portion preferably being flexible or pliable relative to the proximal portion. The distal portion 410 may also be stiff or rigid to the same degree as is proximal portion 408, particularly when it is desired to provide a further increase in tearing leverage, as the proximal and distal end portions can thus act as a single lever.

The flexibility of the distal portion is desired, not due to any particular advantage in the operation of the opening device, but for bulk or quantity packaging considerations, wherein, if necessary, the portion extending from the package 400 may be folded down onto the package and contents thereof. The lever arm may preferably be made of a single piece of material, in which case, the flexibility of the distal portion may be achieved by making that portion much thinner than the thickness of the stiff proximal end portion of the lever arm. As noted previously, the entire lever arm 406 (i.e., both the proximal and distal ends) may alternatively be made of a single thickness, in which case the lever arm will be stiff along its entire length.

As represented by broken lines in FIG. 19, only a lower end 412 of the proximal portion is secured to the package 400 by heat sealing or other bonding or welding means. The upper edge 414 of the bonded region preferably takes the shape of a point, which, as will be explained in more detail, serves to concentrate tearing forces at theft point or otherwise creates a tear initiation site. The unbonded section 416 of the proximal portion 408 extending between the bonded region and the flexible distal portion will be free to be pulled away from the surface of the package upon the application of a force tending to move it in that direction.

The flexible distal portion of the opening device is preferably temporarily adhered to the package 400, by a lightly adherent peel-off glue 411 or other means known in the art. Again, this is done largely for packing and shipping these packages 400 in bulk, and, in this instance, as an aid in attractively displaying the product in its packaging. To that end, a throughhole 420 is provided through the distal end portion of the device at the far end thereof, which is preferably sized to extend above the upper surface 418 of the package 400. The package and its contents may, in this arrangement, be displayed on hooks at the point of sale by the opening device 404 itself. The provision of a throughhole in this and in all other depicted embodiments allows for such a display of the package and also provides the further advantage that tactile feel between the thumb and the selected opposing finger is provided to the person operating the device, which may in many instances improve the ability to grip and hold onto the opening device in opening the package.

FIGS. 20 A–D depict the sequence employed by a person using the opening device of FIG. 19 to open the package to gain access to the contents thereof. The person will effect the opening of the package using the opening device 404 by first gripping the flexible distal portion 410 of the device. FIG. 20A shows the opening device at a first stage of operation, wherein the flexible distal portion 410 of the device has been peeled away from its original position (shown in broken lines) such that the flexible portion is no longer adhered to the packaging material, and extends at a non-zero angle away from the surface of the packaging material to which it had previously been temporarily adhered.

Figure 20A:
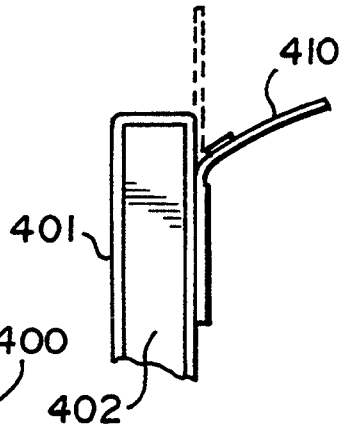
FIGS. 20 A–D are a series of side views showing the operational sequence of using the FIG. 19 device to open a package.
Figure 20B:
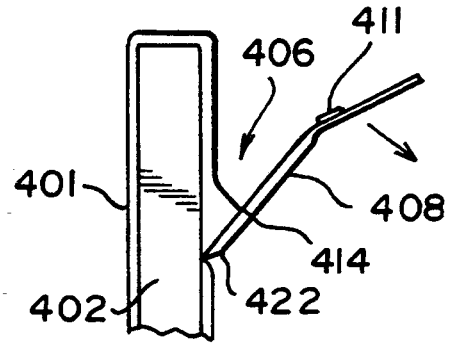

FIG. 20B shows the next step in the operation of the opening device, and the movement of the device from its position in FIG. 20A to the position in FIG. 20B illustrates the lever action of the device in increasing the tearing forces exerted at the upper edge 414 of the bonded region at the proximal portion 408 of the device. In order for the rigid proximal portion to properly function as a lever, the product or contents 402 within the packaging material must itself have sufficient structural integrity such that it does not deform to a great extent when force is exerted on it by the bottom edge 422 of the lever arm 406. A product with this characteristic will provide a bearing surface for lever arm 406 thereby enabling the bottom edge 422 to establish a fulcrum or pivot point when that edge comes into contact with (through the thickness of the packaging material) the product 402, as illustrated in FIG. 20B.

It can also be seen in FIG. 20B that, while the fulcrum of the lever arm is established by the interaction of the bottom edge 422 of the lever arm with the product contained within the package, the load being operated on by the lever arm 406 in applying tearing forces to the package is located at the upper edge 414 of the bonded region 412 of the lever arm 406. This upper edge of the bond is preferably configured to converge to a narrowed region or point (see FIG. 19), which will hereafter be referred to collectively as a point, as it is believed that this will initially concentrate or focus the tearing forces at that point.

The effectiveness of this embodiment of the opening device of the present invention also is dependent to some extent on the relationship between the product contained within the packaging material and the packaging material itself. In order for the lever to generate a tearing force sufficient in magnitude to open the package, the packaging material should conform closely to the product, so that any slack or looseness can be taken up in moving the lever arm 406 from its original position to the position illustrated in FIG. 20B. It is only after much, if not all, of the slack is taken up at the region of interest that the lever will begin to induce stresses in the packaging material which will result in the package being torn open. It is for this reason that this embodiment of the opening device is especially well suited for use with products packaged in a shrink packaging material such as oriented polyethylene or another polymer film or film laminate having a thermoplastic memory. Shrink packaging is possibly more commonly known in the consumer environment as "shrink wrap", however, those working in the art will readily understand what is meant by the term shrink packaging. This embodiment, as well as the embodiments which will be described later with respect to FIGS. 21–24 and 25–28, are also particularly well suited for use with the types of packages or packaging known as "blister pack" and "skin pack", both of which are well known in the art and which will be discussed in greater detail with respect to FIGS. 25–28.

Figure 20C:
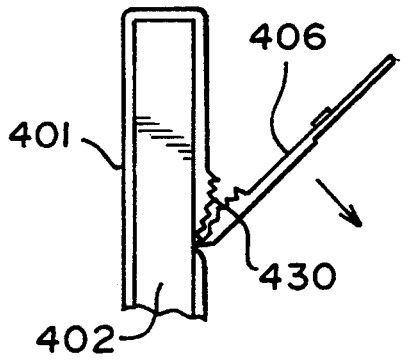

The movement of the lever arm 406 from its position in FIG. 20B, at which it is exerting a tearing force on the packaging material, to the position shown in FIG. 20C, shows that at a given level of strain induced in the packaging material, the film will fracture or break, as at 430, thereby creating an opening in the package. Further rotation of the lever arm 406 about the fulcrum will cause the material to generally continue tearing along the peripheral edges of the region where the proximal portion of the lever arm is bonded to the packaging material.

Figure 20D:
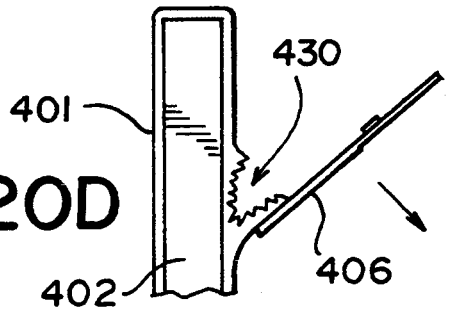
Figure 25:
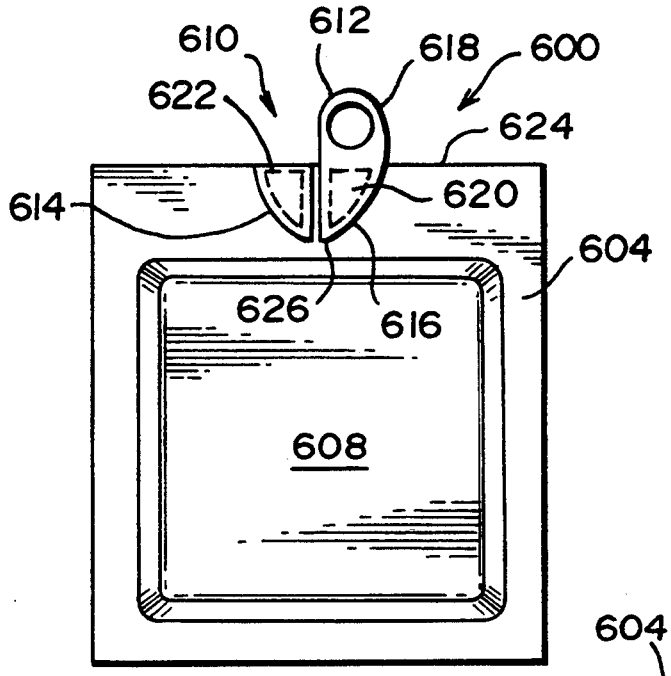
FIG. 25 is an elevation view of another preferred embodiment of the opening device of the present invention.
Figure 26:
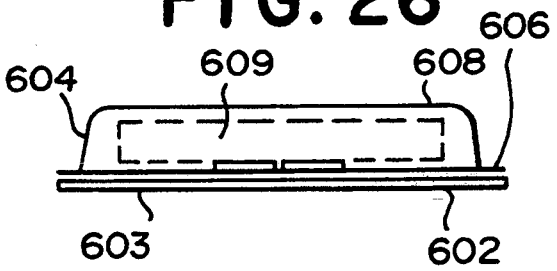
FIG. 26 is a top plan view of the FIG. 25 embodiment.
Figure 27:
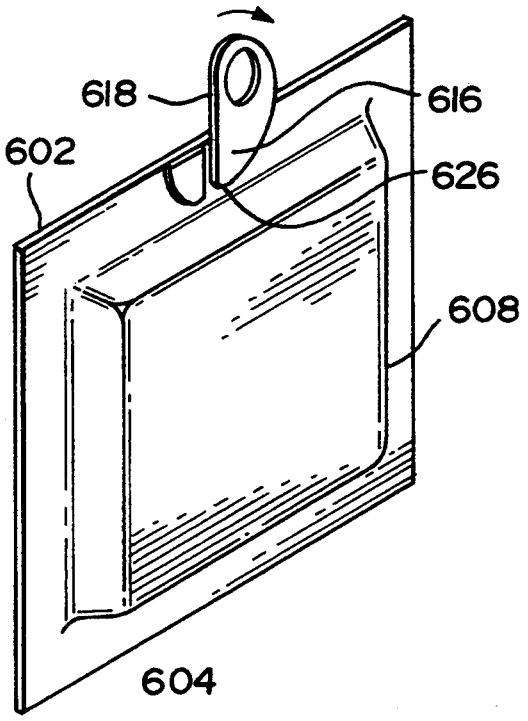
FIG. 27 is a perspective view of the FIG. 25 embodiment.

FIG. 20D illustrates the completion of the opening of the package through leverage imparted about the fulcrum. At this stage, the person opening the package can use the opening device 404 as a convenient gripping surface for continuing to tear open the package from the region where the tear was started with the aid of the opening device. The package can be augmented with a tear strip of some form extending from the lower edge of the lever arm 406 along the surface of the packaging material, in a manlier substantially identical to the tear strip shown and described with respect to FIG. 8.

FIGS. 21–24 depict another embodiment of a single lever opening device 500 in accordance with the present invention. This opening device is also especially well suited for use with packages in which the packaging material closely conforms to the product maintained inside the package, and wherein the product has sufficient structural integrity so as to provide a surface against which a fulcrum can be established.

Lever 502, while depicted in a somewhat different shape than the lever in FIGS. 19 and 20A–D, and more in the shape of the levers in FIGS. 1–18, is designed to operate much in the same manner as the FIG. 19 lever, in which a fulcrum is realized when the bottom edge of the lever 502 is brought into contact (through the thickness of the packaging material) with the product being stored in the package. Lever 502 may therefore be rigid along its entire length, or may have a flexible distal end in the same manner as does the lever in the FIG. 19 embodiment. Lever 502 is preferably bonded to the packaging material 510 in the same manner as in the lever of FIGS. 19 and 20A–D, although the shape of the upper edge of the bonded region may differ in order to have the tearing forces focused at a point or narrowed region nearest the adjacent tear bar, as shown at 503 (in broken lines) in FIG. 21. It may, in fact, prove to be most economical, from a manufacturing standpoint, to provide the FIG. 19 embodiment with a sealed region tapering to the point or narrowed region at one side of the sealed region, in the same manner as shown in FIG. 21. Broken lines 505 in FIGS. 21 and 23 represent the periphery of the region at which tear bar 506 is sealed to the packaging material.

The FIGS. 21–24 embodiment provides the additional feature that the opening device 500 includes a tear bar 506 which is affixed to the package adjacent the lever 502 and in close proximity thereto. The tear bar is bonded to the packaging material at a location overlying the product contained in the package, as is the lever 502. The tear bar 506 as depicted is of a complementary shape to that of the proximal end 504 of lever 502, and has a straight edge extending adjacent to a straight edge 508 on the lever 502. The tear bar functions to effectively pin down the packaging material 510 against the surface of the product 512 contained in the package. This has the effect of eliminating substantially all slack in the packaging material at the precise point of interest where the lever 502 will be employed to tear open the package. As such, this embodiment may find broader use than the foregoing embodiment illustrated and discussed with respect to FIGS. 19 and 20A–D, in that the close conformance of the packaging material to the product packaged is not quite as critical when a tear bar is provided.

Substantially the only difference in operating the opening device of this embodiment over that of the FIG. 19 embodiment is that, prior to rotating lever 502 to impart tearing forces to the packaging material, the person presses the tear bar 506 into contact with (through the thickness of the packaging material) the product 512. The lever 502 is then operated in the same manner as that described with respect to FIGS. 20A–D above. The tear bar, in substantially preventing any shifting of the material, allows the lever to immediately apply tearing forces to the packaging material 510, and further serves to help concentrate the tearing forces by prohibiting the material pinned thereunder from yielding in response to the application of tearing forces.

Yet another preferred embodiment of the opening device of the present invention is depicted in FIGS. 25–28. The opening device of this embodiment is structurally similar to the device in FIGS. 21–25, however, it is used in conjunction with a type of packaging whereby the product contained by the package need not be relied upon to provide the surface against which the lever arm will pivot at a fulcrum point.

The type of package 600 illustrated in FIGS. 25–28 is known in the industry as blister pack. Blister pack employs a substantially stiff backing material 602, commonly made of cardboard stock, with a transparent, flexible polymeric sheet or film 604 laminated or adhered thereto in a manner well known in the art. The backing material 602 and sheet 604 are shown in a prejoined condition in FIG. 26, for the purpose of clearly illustrating the structure of the individual components. The sheet 604 has a substantially planar peripheral flange 606 which is provided as the surface to be adhered to the stiff backing material 602. Inward of the peripheral flange 606, the sheet protrudes out of the plane of the peripheral flange to form a bubble or blister 608. The product contained in this blister pack package 600 is retained in the space bounded by the blister 608 and the backing material 602, as also best seen in FIG. 26, in which the product is schematically represented by broken lines 609.

The opening device 610 in this embodiment preferably comprises lever arm 612 and tear bar 614. The lever arm and tear bar are affixed to the peripheral flange 606 of sheet 604, preferably by use of a pressure-sensitive adhesive, a heat seal, a sonic weld, or any other manner deemed appropriate by a person of ordinary skill in the art. In this embodiment, the proximal end portion 616 of the lever arm is defined as that part of the lever arm which overlies and is bonded to sheet 604, and the term distal end portion 618 will refer to the portion of the lever arm 612 which is not bonded to sheet 604. The proximal end portion in this embodiment will be sufficiently rigid to act as a lever, as will the immediate adjacent part of the distal end section. As with the embodiments depicted in FIGS. 19–24, the outermost portion of the distal end may be either rigid or flexible, at the discretion of the package designer. A throughhole 613 is also preferably provided at the distal end of the lever arm.

It is preferred, in this embodiment, that the bond 620 (broken lines in FIG. 25) between the lever arm 612 and the flange 606, as well as the bond 622 (broken lines in FIG. 25) between the tear bar 614 and the flange 606, extend to the peripheral edge 624 of flange 606, in order to improve the ability of the device to initiate a tear at this edge 624 of the sheet 604 in the gap between the lever arm and tear bar.

Opening device 610 operates on the same principles of using increased tearing force through the application of leverage, and of concentrating the tearing forces at a specific area, as do all of the foregoing embodiment. Lever arm 612 is properly operated by rotating the distal end 618 thereof in a direction away from the plane of the backing sheet 602, as best seen in comparing FIGS. 27 and 28. When rotated in this direction, a lower edge portion 626 of the proximal end portion 616 exerts a force against backing material 602, which force is matched by an opposing force of the substantially stiff material comprising backing material 602, thereby creating a fulcrum point about which lever arm 612 will pivot. The load upon which lever arm 612 will operate is the flexible sheet material 604 at the upper edge of the bonded region 620, which, as noted previously, is preferably at a peripheral edge 624 of the sheet material.

The tearing forces are also concentrated, i.e., are not distributed or attenuated along the entire upper edge of the flexible sheet material, by the provision of and use of tear bar 614. Prior to operating the lever arm 612 in the manner indicated in FIGS. 27 and 28, the user will grip the exposed surface of the tear bar and the back surface 603 (FIG. 26) of the backing material, which will serve to isolate the material in the space between the lever arm 612 and the tear bar 614, and will concentrate the tearing forces in that area. As represented by numeral 628 in FIG. 28, a clean tear in the flexible packaging material can thus be initiated at that area, and a complete opening of the blister pack package 600 may be effected, once the material adjacent the lever arm is completely torn, by continuing to pull lever arm 612 in a direction away from the backing material 602.

Figure 28:
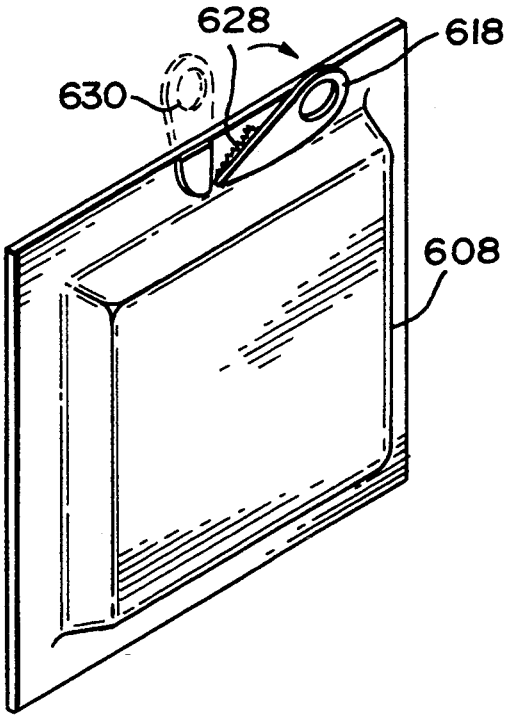
FIG. 28 is a further perspective view of the FIG. 25 embodiment after the device has been used to initiate the opening of a package.

It will be readily recognized by those skilled in the art that the tear bar 614 may, in fact, have an identical configuration to lever arm 612, as represented by broken lines 630 in FIG. 28. This may be desired for economy in manufacture, in that the handling of the two components may prove to be easier that if two differently shaped or sized components are used. Product manufacturers may also deem this alternative configuration to be more aesthetically pleasing. In this configuration, the roles and functions of the lever arm and tear bar are interchangeable and may be reversed depending on which of the two components the user decides to operate as the lever arm.

The embodiment described with respect to FIGS. 25–28 above is also equally suitable for use on a type of packaging known in the art as "skin pack" packages. Skin pack is similar to blister pack in construction insofar as the use of a substantially stiff backing material is common to both. In addition, skin pack packaging employs a flexible packaging material joined to the backing material at a periphery of the flexible material. The principal distinguishing feature of the skin pack as compared with blister pack is that, while the blister in blister pack is generally preformed into a shape and size such that it will accommodate a particular product therein, the blister generally does not take on the shape or contours of the product retained in the package. In contrast, skin pack will assume the contours of the product and will tightly retain the product against the backing material. This is done by placing the product between the unjoined backing and a flexible film, forming a substantially airtight enclosure around the product with the backing material and the flexible material, and drawing a vacuum in that enclosure through small holes in the backing material to bring the flexible material into intimate contact with the product, and with the backing at areas on the backing where the product is not present. The positioning of the opening device 610 of FIGS. 25–28, and its manner of operation, will be substantially identical on a skin pack package as on a blister pack package.

The foregoing description includes various details and particular features according to preferred embodiments of the present invention, however, it is to be understood that this is for illustrative purposes only. Various modifications and adaptations may become apparent to those of ordinary skill in the art without departing from the spirit and scope of the present invention. For example, although the wing-like members of the device in most of the figures are depicted as forming an approximately "heart shaped" device, the shape of the wing-like members may take on numerous other forms, provided sufficient area exists for the placement of the fingers and thumbs for gripping the device. Accordingly, the scope of the present invention is to be determined by reference to the appended claims.

What is claimed is:

1. A package comprising:

a product;

a flexible packaging material surrounding said product in close conformance therewith including in an area at which said flexible packaging material is bonded to an opening device; and said opening device comprising a lever arm having a proximal end portion, said proximal end portion being bonded to said flexible packaging material at an area of said product, a bond between said proximal end portion and said packaging material existing at least at a portion of said proximal end region located at a distance away from a bottom edge of said lever arm, an upper part of said proximal end portion not being bonded to said packaging material; and whereby said product provides a surface against which and about which said bottom edge of said lever pivots, causing rupture of said packaging material.

2. A package as recited in claim 1 wherein said lever arm also has a distal end portion extending away from said upper part of said proximal end portion.

3. A package as recited in claim 2 wherein said distal end portion of said lever arm has an upper portion which extends above an upper extent of said product and said packaging material.

4. A package as recited in claim 3 wherein said upper portion of said distal end portion has a throughhole therein.

5. A package as recited in claim 2 wherein said distal end portion of said lever arm is flexible relative to said proximal end portion of said lever arm.

6. A package as recited in claim 5 wherein said distal end portion of said lever arm has an upper portion which extends above an upper extent of said product and said packaging material, and has a throughhole in said upper portion.

7. A package as recited in claim 1 wherein said bond between said proximal end portion of said lever arm and said packaging material includes an upper edge converging to a point in a direction away from said bottom edge of said lever arm.

8. A package comprising;

a product;

a flexible packaging material surrounding said product in close conformance therewith; and an opening device comprising a lever arm having a proximal end portion, said proximal end portion being bonded to said flexible packaging material at an area of said product, a bond between said proximal end portion and said packaging material existing at least at a portion of said proximal end region located at a distance away from a bottom edge of said lever arm, an upper part of said proximal end portion not being bonded to said packaging material;

wherein said product provides a surface against which and about which said bottom edge of said lever pivots, causing rupture of said packaging material; and wherein said opening device further comprises a tear bar bonded to said packaging material adjacent to said proximal end of said lever arm and overlying a surface of said product adjacent said surface over which said lever arm overlies.

9. A package as recited in claim 8 wherein said lever arm also has a distal end portion coextensive with said proximal end portion.

10. A package as recited in claim 9 wherein said distal end portion of said lever arm has an upper portion which extends above an upper extent of said product and said packaging material.

11. A package as recited in claim 10, wherein said upper portion of said distal end portion has a throughhole therein.

12. A package as recited in claim 9 wherein said distal end portion of said lever arm is flexible relative to said proximal end portion of said lever arm.

13. A package as recited in claim 12 wherein said distal end portion of said lever arm has an upper portion which extends above an upper extent of said product and said packaging material, and has a throughhole in said upper portion.

14. A package as recited in claim 8 wherein said bond between said proximal end portion of said lever arm and said packaging material includes an upper edge converging to a point in a direction away from said bottom edge of said lever arm.

15. A package as recited in claim 8 wherein said lever arm has at least one straight edge, and said tear bar has at least one straight edge, and wherein said lever arm and said tear bar are bonded to said packaging material such that said straight edge of said lever arm and said straight edge of said tear bar are mutually parallel, and define a small gap therebetween.

16. A package as recited in claim 5 further comprising means for temporarily attaching said distal end portion to said packaging material such that said distal end portion can be peeled away from said packaging material without tearing open said package.

17. A package comprising:

a flexible packaging material portion joined to a substantially stiff packaging material portion at a periphery of said flexible packaging material, said package being adapted to hold a product therein; and an opening device comprising a lever arm having a proximal end portion bonded to said flexible packaging material at an area of said flexible packaging material overlying and substantially in contact with a surface of said substantially stiff packaging material, and a distal end portion which is not bonded to said flexible packaging material, a bond between said proximal end portion and said flexible packaging material existing at least at a portion of said proximal end region located at a distance away from a bottom edge of said lever arm; and wherein said substantially stiff packaging material provides a surface against which and about which said bottom edge of said lever arm pivots, causing rupture of said packaging material.

* * * * *